US007028941B2

(12) United States Patent
Ibrahim et al.

(10) Patent No.: US 7,028,941 B2
(45) Date of Patent: Apr. 18, 2006

(54) SEAM TAPE APPLICATOR

(75) Inventors: Samir Ibrahim, Carlisle, PA (US); Kenneth Landis, Grantham, PA (US); Richard Stoffels, Eden Prairie, MN (US); Kurt Behner, Mt. Holly Springs, PA (US)

(73) Assignee: Carlisle Management Company, Syracuse, NY (US)

( * ) Notice: Subject to any disclaimer, the term of this patent is extended or adjusted under 35 U.S.C. 154(b) by 0 days.

(21) Appl. No.: 10/700,413

(22) Filed: Nov. 4, 2003

(65) Prior Publication Data

US 2004/0129387 A1 Jul. 8, 2004

Related U.S. Application Data

(60) Provisional application No. 60/423,824, filed on Nov. 5, 2002.

(51) Int. Cl.
*B65H 59/02* (2006.01)

(52) U.S. Cl. ..... 242/422.5; 156/577

(58) Field of Classification Search ..... 242/422.4, 242/422.5, 557; 156/574, 577, 579, 523
See application file for complete search history.

(56) References Cited

U.S. PATENT DOCUMENTS

| | | | | |
|---|---|---|---|---|
| 3,374,139 A | | 3/1968 | Fritzinger | 156/523 |
| 3,389,040 A | | 6/1968 | Fritzinger | 156/523 |
| 3,463,694 A | | 8/1969 | Roshia | 156/523 |
| 4,022,651 A | * | 5/1977 | Larkins et al. | 156/577 |
| 4,089,730 A | | 5/1978 | Mahn | 156/541 |
| 4,243,468 A | * | 1/1981 | Boyd | 156/577 |
| 4,313,780 A | * | 2/1982 | Ford, Jr. | 156/577 |
| 4,460,433 A | | 7/1984 | Boyd | 156/574 |
| 4,648,935 A | | 3/1987 | Brown et al. | 156/577 |
| 4,711,407 A | * | 12/1987 | Boon | 242/557 |
| 4,824,516 A | | 4/1989 | Ishihara et al. | 156/523 |
| 4,913,772 A | | 4/1990 | Taylor et al. | 156/499 |
| 5,013,386 A | | 5/1991 | Myers et al. | 156/351 |
| 5,290,390 A | * | 3/1994 | Roman et al. | 156/577 |
| 5,342,466 A | | 8/1994 | Eidson | 156/179 |
| 5,439,540 A | | 8/1995 | Lippman et al. | 156/71 |
| 5,552,014 A | | 9/1996 | Morris | 156/577 |
| 5,624,511 A | | 4/1997 | Lippman | 156/64 |
| 5,800,668 A | | 9/1998 | Bumb | 156/577 |
| 6,413,013 B1 | * | 7/2002 | Requena | 156/523 |
| 6,478,068 B1 | * | 11/2002 | Brown | 156/577 |
| 6,595,455 B1 | * | 7/2003 | Romes | 242/422.5 |

* cited by examiner

*Primary Examiner*—William A. Rivera
(74) *Attorney, Agent, or Firm*—Wood, Herron & Evans, L.L.P.

(57) ABSTRACT

Seam tape applicator includes a frame which holds a roll of seam tape and is supported by two pressure rollers from the front and rear of the frame. A tensioning plate applies pressure against the roll of seam tape to maintain proper tension on the seam tape as it is applied. A guide bar extends forwardly from the front of the seam tape applicator to indicate the location of the seam tape as it is being applied.

2 Claims, 3 Drawing Sheets

SEAM TAPE APPLICATOR

The present application claims the filing benefit of pending U.S. Provisional Application Ser. No. 60/423,824, filed Nov. 5, 2002, the disclosure of which is hereby incorporated herein by reference in its entirety.

BACKGROUND

Membrane roofs comprise large sheets of polymeric membrane that are laid over the support structure of the roof. Because there is a limitation as to the width of the membrane which can be produced, lap seams are required in order to form a continuous membrane over the roof. The lap seams are formed using various adhesives. One particular type of adhesive is a lap seam tape. These seam tapes are well known. Generally, they are applied by cleaning the overlapping edges of adjacent membrane sheets. A primer is applied and the tape is manually rolled out and pressed onto the edge of a lower sheet and an edge of an upper sheet is then pressed down against the seam tape to form the seam.

This is all done manually and is very strenuous and time consuming.

SUMMARY OF THE INVENTION

The present invention is premised on the realization that a seam tape applicator can be used to apply the seam tape to an edge of a membrane sheet tightly adhering the tape to the edge of the sheet. The seam tape applicator of the present invention includes a frame that holds a roll of seam tape and includes front and rear pressing rollers. It further includes a tensioning device which presses against the roll of seam tape and maintains tension on the tape as it is applied. An adjustable guide bar extends from the front of the device to ensure that the tape is properly positioned.

The objects and advantages of the present invention will be further appreciated in light of the following detailed description and drawings in which:

DETAILED DESCRIPTION

Figure 1:
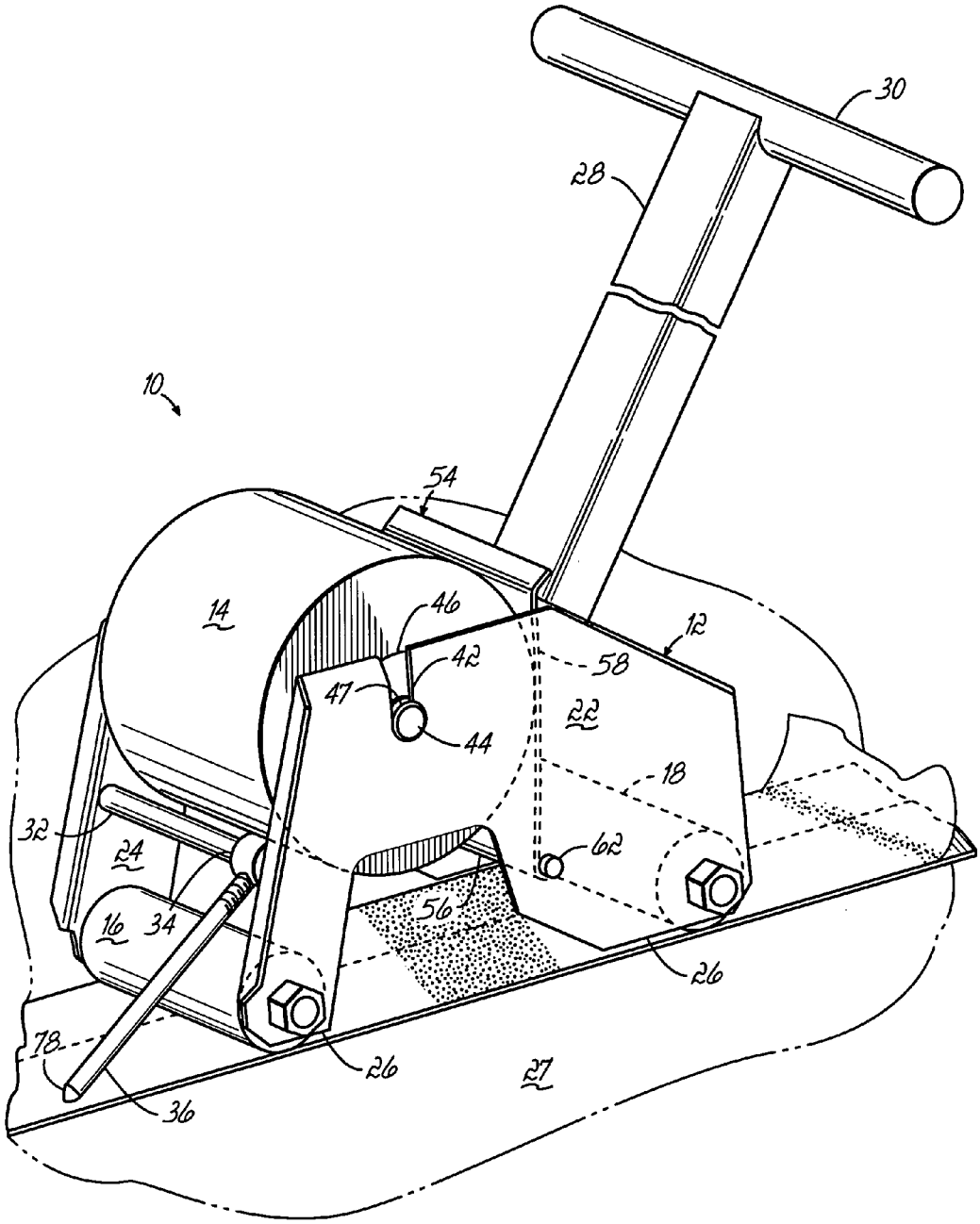
FIG. 1 is a perspective view of the present invention.

As shown in FIG. 1, the seam tape applicator 10 of the present invention includes a frame 12 which supports a roll 14 of seam tape. The frame 12 also supports first and second rollers 16 and 18.

More particularly the frame includes mirror image right and left panels 22 and 24 respectively. Rollers 16 and 18 are rotably supported by panels 22 and 24 extending between the two. These rollers are made of iron or other heavy material which will apply a significant amount of pressure. As shown, the rollers 16 and 18 extend below the bottom edge 26 of frame 12 thus supporting the frame above the surface of the membrane 27.

Extended from the rear of frame 12 is an arm 28 which extends to a handle 30. This allows one to push the seam tape applicator without bending over. Extended between frame members 22 and 24 is a bar 32 which is welded or bolted to frame members 22 and 24. Attached to the bar 32 is a collar 34. The collar 34 includes an internally threaded opening that extends through the collar. A threaded guide rod 36 screws into the opening and when it engages bar 32, holds the collar 34 and the guide rod 36 in position. This can be adjusted across bar 32 as desired.

Figure 2:
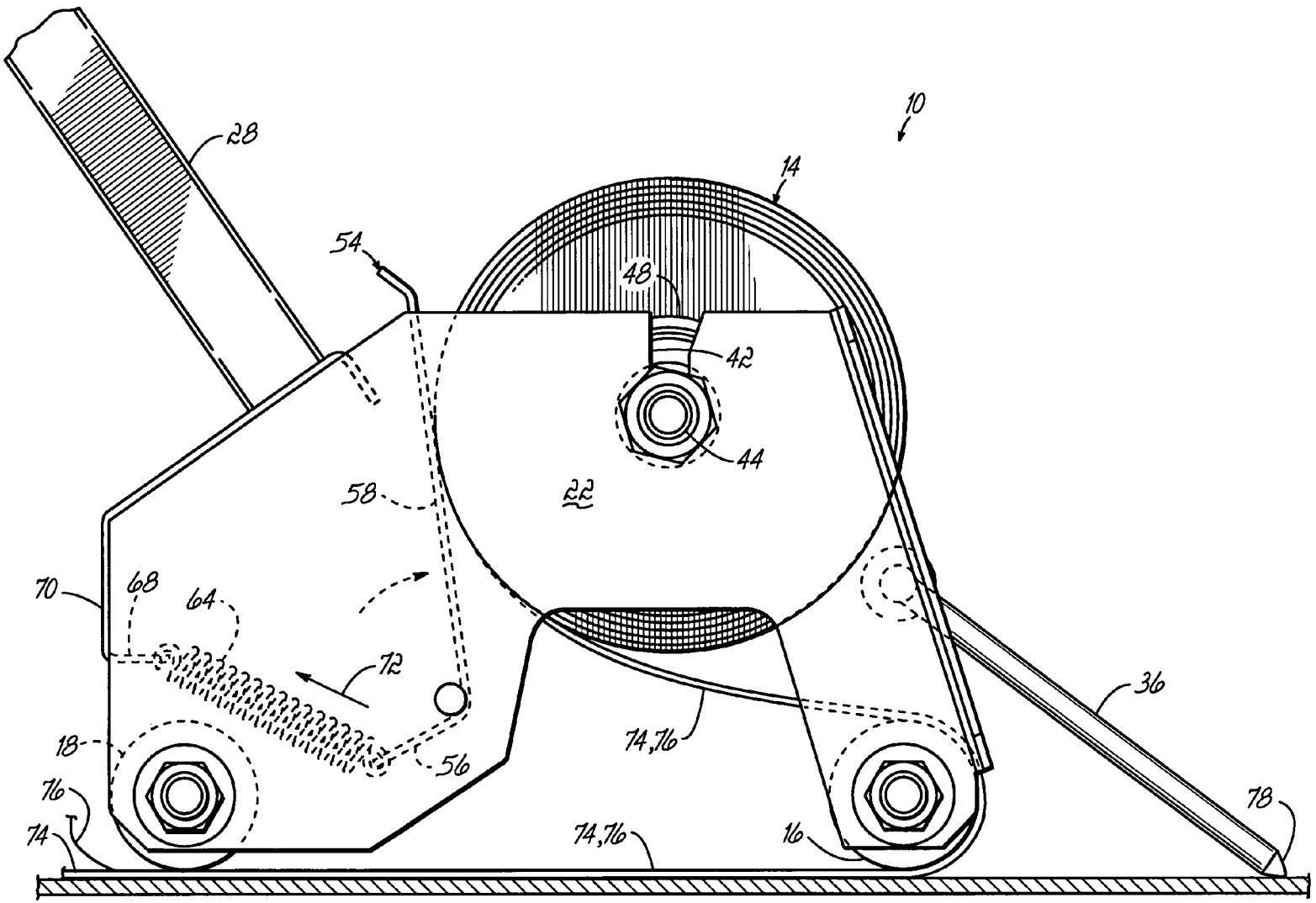
FIG. 2 is a partial side elevational view of the present invention.
Figure 3:
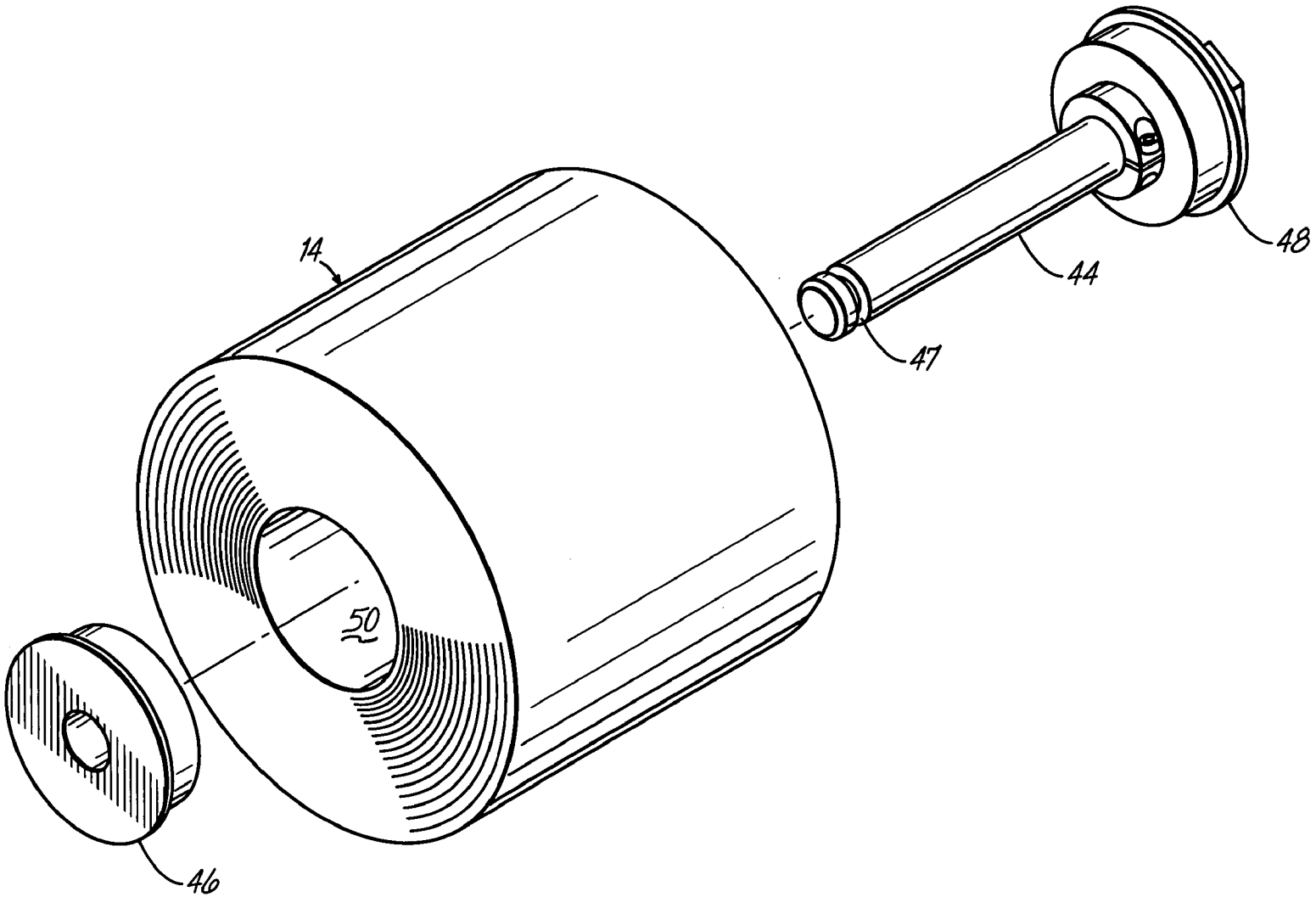
FIG. 3 is an exploded view of the seam tape roll.

A pair of slots 42,42 (one shown in FIG. 1, the other shown in FIG. 2) in plates 22 and 24 support a rod or axle 44 which in turn supports the roll 14 of seam tape. More particularly as shown in FIG. 3, the rod 44 includes first and second caps 46 and 48 which fit into the central hollow portion 50 of roll 14. Either end of the rod 44 includes an annular grooves 47 (one shown) which engage the side walls 22 and 24, respectively of the frame 12 holding the rod 44 and the roll 14 in position.

Rearwardly of roll 14 is a tensioning plate 54. As shown in FIG. 2, plate 54 includes a lower rearwardly bent portion 56 and a larger upwardly extended portion 58. The plate 54 is welded to a rod 62 which extends from panel 22 to 24 and permits the plate 54 to pivot about the rod 62. A spring 64 extends from lower portion 56 to a tab 68 which extends from rear wall 70. Spring 64 pulls the lower portion 56 in the direction of arrow 72 forcing upper portion 58 against the roll 14 inhibiting its rotation independently. Other tensioning mechanisms can be employed such as spring steel flexed against roll 14.

The seam tape in roll 14 includes an actual layer of seam tape 74 and an upper release layer 76 which is separated from the seam tape after it is applied to the lower edge of a seam.

Also shown in FIG. 2, the tape is applied from the roller 14 by threading it behind rod 32 around the forward edge of roller 16 and then rearwardly under rear roller 18. The guide rod is adjusted so that the tip 78 of guide rod 36 indicates where the edge of the seam tape will be positioned as the tape dispenser is pushed. Thus if the roll 14 does not extend completely across the frame, one can slide collar 34 across 32 to provide a proper indication of the edge of the seam tape. The seam tape applicator 12 is then pushed forwardly. The tensioning plate 54 will inhibit rotation of roll 14 and turn pressing the seam tape against roller 16 so that the seam tape is properly applied to the seam without bubbles or wrinkles. The weight of the device 10 is concentrated at rollers 16 and 18 and causes the seam tape to bind to the edge of the membrane. Release sheet 76 will then be removed and the upper overlapping edge (not shown) of the next adjacent sheet of membrane will be applied to the tape 74 and pressed together to form a water tight seal.

Thus, the present invention provides an improved method of applying seam tape. The guide rod insures that the tape is applied accurately. The tensioning plate ensures that the seam tape is applied smoothly over the edge of the membrane without wrinkles or bubbles to provide a secure seam. Further, the rollers will ensure that adequate pressure is applied against the seam tape towards the membrane also to form a tight seal. This does not require the roofer to continuously bend over greatly simplifying the application of the seam tape and expediting the same. Thus, the present invention provides a significant improvement in the method of applying seam tape.

This has been a description of the present invention along with the preferred method of practicing the present invention. The invention itself should only be defined by the dependent claim whereby we claim:

The invention claimed is:

1. An apparatus for dispensing seam tape to an edge of a membrane roofing comprising:

a frame;

a first roller mounted at a front lower portion frame adapted to press seam tape against an edge of membrane roofing;

a second roller mounted in a rear lower portion of said frame adapted to press seam tape against an edge of roofing membrane;

a roll of seam tape supported on said frame above said first and second rollers;

a tensioning mechanism pressing against said roll inhibiting rotation of said roll; and a guide bar slidably mounted to said frame extending forward from said frame and said first roller.

2. The apparatus claimed in claim 1 wherein said tensioning mechanism is a tensioning plate spring biased against said roll.

* * * * *